United States Patent [19]

Haase

[11] 4,279,745

[45] Jul. 21, 1981

[54] MAGNET ATTACHMENT FOR VACUUM CLEANERS

[76] Inventor: Gerald A. Haase, 1005 Country Club Rd., Lake Oswego, Oreg. 97034

[21] Appl. No.: 172,126

[22] Filed: Jul. 25, 1980

[51] Int. Cl.[3] ..... B03C 1/30

[52] U.S. Cl. ..... 209/215; 15/339

[58] Field of Search ..... 209/215; 15/339, 415 R; 55/100; 211/DIG. 1, 13, 71; 206/818, 350, 813, 460, 820; 248/205 A, 206 A; 335/302, 303, 306, 285; 428/900

[56] References Cited

U.S. PATENT DOCUMENTS

| | | | |
|---|---|---|---|
| 2,288,115 | 6/1942 | Soldanels | 55/100 X |
| 2,474,036 | 6/1949 | Curley | 211/DIG. 1 |
| 2,677,461 | 5/1954 | Bodey | 209/215 |
| 3,021,001 | 2/1962 | Donofrio | 206/820 X |
| 3,254,440 | 6/1966 | Duggar | 428/900 X |
| 3,370,365 | 2/1968 | Vosbikian | 206/813 X |
| 3,727,658 | 4/1973 | Eldridge | 206/818 X |
| 4,006,512 | 2/1977 | Saulson | 209/215 X |

*Primary Examiner*—Ralph J. Hill
*Attorney, Agent, or Firm*—Oliver D. Olson

[57] ABSTRACT

A vacuum cleaner magnet attachment for picking up pins, needles and other magnetic metal material concealed in rugs and carpets is in the form of a longitudinally flexible housing provided with a plurality of magnet-containing pockets laterally spaced apart by thin webs, the attachment being secured to the front lowermost wall of a vacuum cleaner.

4 Claims, 4 Drawing Figures

MAGNET ATTACHMENT FOR VACUUM CLEANERS

BACKGROUND OF THE INVENTION

This invention relates to vacuum cleaners, and more particularly to a magnet attachment for the front end of various vacuum cleaners for the purpose of picking up magnetic metal objects concealed in rugs and carpets prior to being introduced into the cleaner itself.

Devices for intercepting metal objects in order to prevent their introduction into the mouth of the cleaner have been provided heretofore. U.S. Pat. No. 2,288,115 discloses a vacuum sweeper having integrated permanently into the sweeper case a set of permanent magnets arranged in at least two parallel rows on the bottom surface of the case adjacent to the mouth of the sweeper.

U.S. Pat. No. 2,677,461 discloses a magnetic pickup device which may be provided for attachment to the front of a vacuum cleaner or may comprise a hand tool which may be propelled across the floor by a handle in the same manner in which a mop is used. The pickup device includes a housing provided with a concave channelway extending longitudinally through its length, the housing permanently incorporating permanent magnet elements which extend partially into the channelway.

SUMMARY OF THE INVENTION

In its basic concept, this invention provides a magnet attachment for the front of a vacuum cleaner for intercepting magnetic metal objects prior to their introduction into the mouth of the vacuum cleaner, the attachment comprising an elongated housing provided with a plurality of magnet-containing pockets spaced apart by thin webs.

It is by virtue of the foregoing basic concept that the principal objective of this invention is achieved; namely, the provision of a magnet attachment which is easily adaptable for attachment to a variety of makes and models of vacuum cleaners.

A further object of this invention is the provision of a magnet attachment of the class described which incorporates adhesive tape across the inner open ends of the pockets for securing the magnets therein, the adhesive tape also serving to mount the attachment to the front wall of the vacuum cleaner.

Another object of this invention is the provision of a magnet attachment of the class described which is adjustable in length to adapt to any length of nozzle head.

A still further object of this invention is the provision of a magnet attachment of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 1:
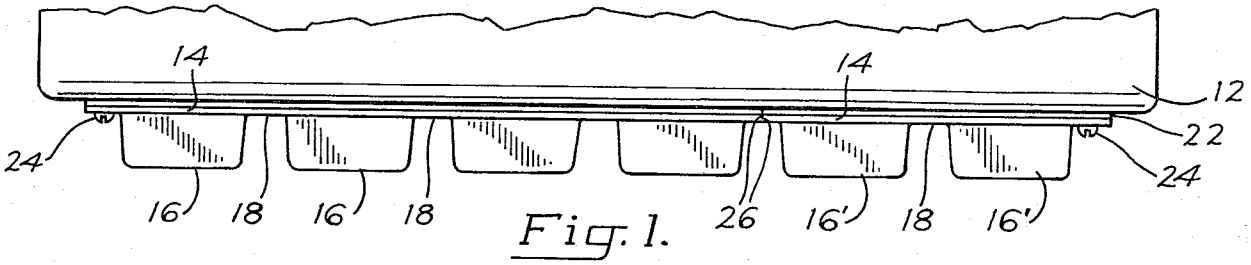
FIG. 1 is a fragmentary plan view of a magnet attachment embodying the features of this invention mounted on the front wall of a vacuum cleaner.
Figure 2:
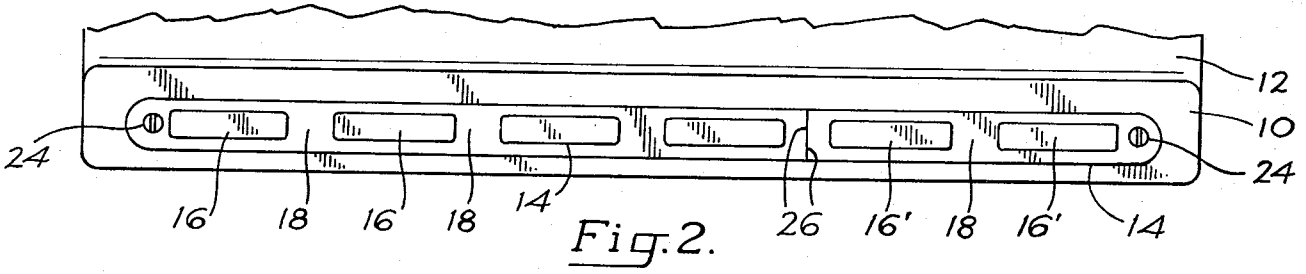
FIG. 2 is a fragmentary front elevation of the magnet attachment as viewed from the bottom in FIG. 1.
Figure 4:
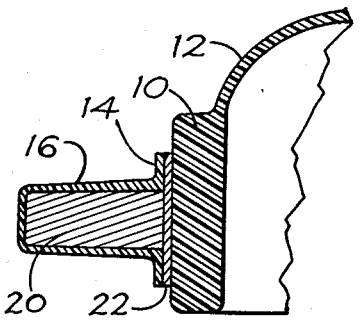
FIG. 4 is a fragmentary horizontal section of the magnet pocket of FIG. 3, taken along the line 4—4 in FIG. 3.
Figure 3:
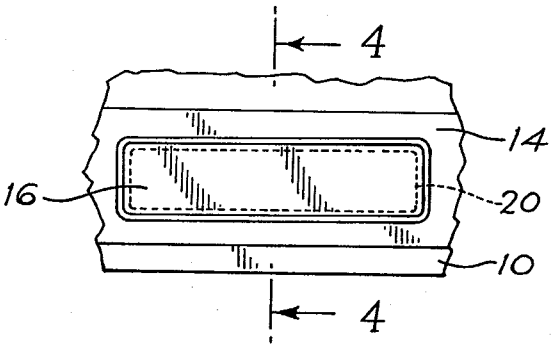
FIG. 3 is a fragmentary front elevation, on an enlarged scale, of one of the magnet pockets shown in FIG. 2.

FIGS. 1 and 2 illustrate the magnet attachment of this invention mounted on the lower front wall 10 of a vacuum cleaner indicated generally as 12.

The magnet attachment is in the form of a longitudinally flexible housing 14 of non-magnetic material, preferably synthetic thermoplastic resin. The housing incorporates a plurality of laterally spaced, outwardly projecting pockets 16, spaced apart by thin webs 18 which allows the housing to be curved longitudinally to accommodate attachment to vacuum cleaners having front wall of diverse shapes.

Each pocket 16 removably contains a permanent magnet 20, and a length of adhesive tape 22 preferably is affixed across the inner open ends of the pockets to prevent the magnets from falling out preliminary to application to the vacuum cleaner.

The adhesive tape 22 may have an adhesive coating on both sides, whereby the tape also serves effectively to secure the attachment to the front wall 10 of the housing of a vacuum cleaner 12. It will be understood, however, that any suitable means may be used for securing the attachment to the vacuum cleaner, including anchor screws 24 through webs 18, as indicated in FIG. 2.

The use of the magnetic attachment described hereinbefore is as follows: The housing 14 containing the magnets 20 is affixed to the front wall 10 of the vacuum cleaner so that the bottom sides of the pockets 16 are slightly above the bottom edge of the front wall 10 of the vacuum cleaner.

The length of the housing 14 may be adjusted as required for various makes and models of vacuum cleaners. If front wall 10 is shorted than housing 14, one or more pockets 16 may be cut off at webs 18. If the front wall 10 is longer than housing 14, one or more pockets 16 from a second housing may be added, as illustrated in FIGS. 1 and 2. For this purpose the adjacent webs 18 of the first and second housings are cut transversely to provide sharp abutting edges 26.

In use, as the vacuum cleaner is moved across a rug or carpet to be cleaned, any magnetic metal objects such as pins, tacks, etc. which have become embedded and thus hidden in the rug or carpet are drawn to the magnets.

In this manner, hazardous material is removed from the floor while at the same time protecting the internal mechanism and collecting bag of the vacuum cleaner from the detrimental effects of such material being drawn in by the suction of the machine.

It will be apparent to those skilled in the art that various changes may be made in the size, shape, type, number and arrangement of parts described hereinbefore without departing from the spirit of this invention and the scope of the appended claims.

Having thus described my invention and the manner in which it may be used, I claim:

1. A vacuum cleaner magnet attachment, including: (a) a longitudinally flexible, elongated housing, (b) said housing incorporating a plurality of magnetreceiving pockets spaced apart along the length of the housing, and (c) a permanent magnet contained removably in each pocket, and (d) securing means for attaching the housing to the lower front wall of a vacuum cleaner so that the pockets extend outward from the vacuum cleaner.

2. The magnet attachment of claim 1 wherein said pockets are spaced apart by thin webs capable of being severed transversely for shortening the length of the housing.

3. The magnet attachment of claim 1 wherein said pockets are open at their inner end for removably receiving magnets therethrough and said means for securing the housing to the front wall of a vacuum cleaner comprises a strip of adhesive tape, with adhesive on both of its sides, extending across the open pocket side of the housing.

4. The magnet attachment of claim 1 wherein the means for securing the housing to a vacuum cleaner comprise anchor screws arranged to extend through the webs and into the lower front wall of a vacuum cleaner.

* * * * *